US006162021A

United States Patent [19]

Sarshar et al.

[11] Patent Number: 6,162,021

[45] **Date of Patent: *Dec. 19, 2000**

[54] SYSTEM FOR PUMPING LIQUIDS USING A JET PUMP AND A PHASE SEPARATOR

[75] Inventors: Mir Mahmood Sarshar, Bucks; Emil Gyorgy Arato, Kempston; Michael Thomas Ralph Butcher, Northants, all of United Kingdom

[73] Assignee: B.H.R. Group Limited, Bedford, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/723,144

[22] Filed: Sep. 30, 1996

Related U.S. Application Data

[63] Continuation of application No. 08/601,002, Apr. 25, 1996, abandoned.

[30] Foreign Application Priority Data

Sep. 6, 1993 [GB] United Kingdom ..... 9318419

[51] Int. Cl.[7] ..... E04F 5/10; E21B 43/12

[52] U.S. Cl. ..... 417/174; 417/170; 417/186; 261/DIG. 75

[58] Field of Search ..... 417/170, 174, 417/176, 151, 186, 76, 77, 79; 261/DIG. 75, DIG. 27; 96/209

[56] References Cited

U.S. PATENT DOCUMENTS

| | | | |
|---|---|---|---|
| 2,444,615 | 7/1948 | Reinhardt | 417/170 |
| 2,707,021 | 4/1955 | Harris | 417/186 |
| 3,022,934 | 2/1962 | Gerald | 417/170 X |
| 4,290,273 | 9/1981 | Meckler | 62/148 |
| 4,673,335 | 6/1987 | Nicodemus | 417/174 |
| 5,298,198 | 3/1994 | La Crosse | 261/DIG. 75 |
| 5,314,613 | 5/1994 | Russo | 261/DIG. 75 |

FOREIGN PATENT DOCUMENTS

| | | | |
|---|---|---|---|
| 1110187 | 6/1961 | Germany | 417/77 |
| 0966326 | 10/1982 | U.S.S.R. | 417/151 |
| 1032229 | 7/1983 | U.S.S.R. | 417/77 |
| 1574920 | 6/1990 | U.S.S.R. | 417/77 |
| 2 101 216 | 1/1983 | United Kingdom . | |
| 2225612 | 6/1990 | United Kingdom | 417/151 |
| 2 239 676 | 7/1991 | United Kingdom . | |
| 2 264 147 | 8/1993 | United Kingdom . | |
| 93/09875 | 5/1993 | WIPO . | |

OTHER PUBLICATIONS

M.M. Sarshar, "High Pressure Wells Drive Low Pressure Producers", 2212 Offshore, vol. 54, No. 8, Aug. 1994, pp. 52, 54.

*Primary Examiner*—Ted Kim
*Attorney, Agent, or Firm*—McDermott, Will & Emery

[57] ABSTRACT

A device for co-mingling fluids from separate sources comprises a jet pump having high and low pressure fluid inlets, and a main outlet for discharging a mixture of the two fluids. A phase separator, receiving fluid from another source of fluid, has a fluid-rich outlet connected to the high pressure inlet of the jet pump, and a gas-rich outlet connected to the main outlet of the jet pump. Fluids from the gas-rich outlet of the separator are mixed with fluids discharged by the jet pump.

7 Claims, 2 Drawing Sheets

SYSTEM FOR PUMPING LIQUIDS USING A JET PUMP AND A PHASE SEPARATOR

This is a continuation of appl. Ser. No. 08/601,002, filed Apr. 25, 1996 now abandoned.

Jet pumps operate by introducing a high pressure or primary fluid through a nozzle and allowing the low pressure or secondary fluid to be entrained into the flow stream. Due to the momentum exchange between the two fluids the resulting pressure of the combined stream will be increased to well above the pressure of the secondary fluid.

An application of mingling liquids is in fuel extraction. Gas or liquid or a mixture of the two phases is extracted from a fuel field. Many fields have a significant variation in production characteristics because of reservoir fragmentation and presence of different production zones. This often results in wells having different flowing wellhead pressures.

Conventional mingling of the products from such wells results in the need to choke the production from the high pressure wells and restricts the production from the low pressure wells. This is costly and inefficient and does not result in optimum recovery.

Jet pumps can be used for such mingling and work satisfactorily when the primary and secondary fluids are both liquids, or both gases. In addition, jet pumps can also be designed to operate satisfactorily when the primary fluid is pure liquid and the secondary fluid consists of a liquid/gas mixture. However satisfactory, jet pump operation cannot be achieved when there is a wide variation in the phase proportions in the primary fluid.

The present invention is aimed at overcoming this problem by providing a co-mingling device in which the jet pump is provided with a phase separator in the primary line, and utilising the liquid phase obtained from the separator as the primary fluid of the jet pump. A bypass arrangement may be provided for the separated gas phase to be mixed back into the fluids from the outlet of the jet Examples of the invention will now be described with reference to the accompanying drawings in which.

Figure 1:
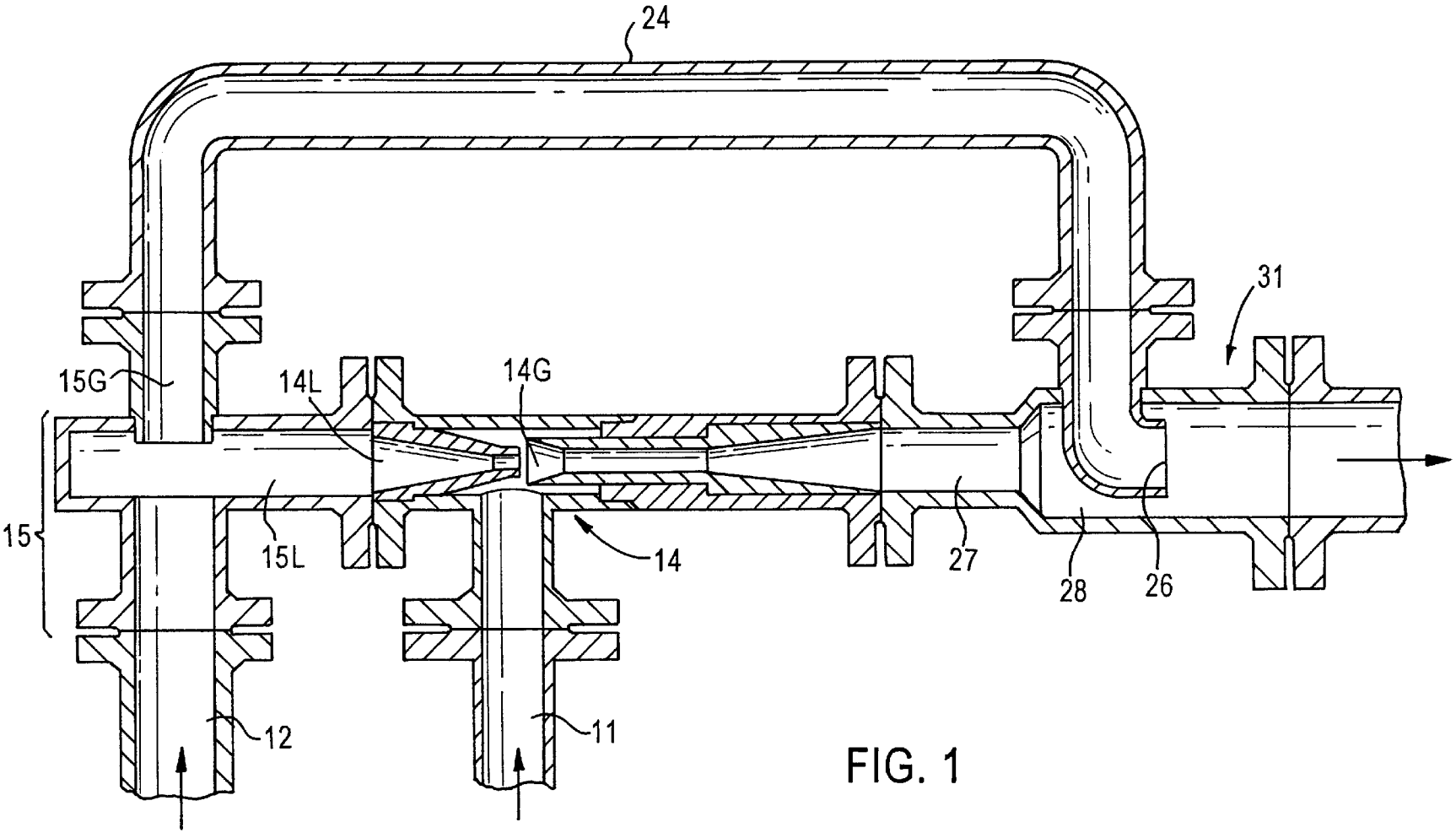
FIG. 1 is a diagrammatic representation of a co-mingling device.
Figure 2:
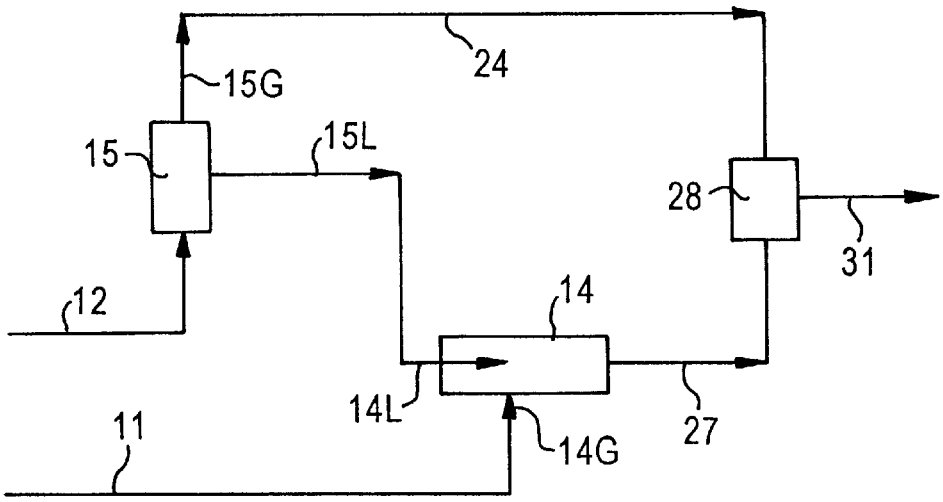
FIG. 2 is a diagram of the device of FIG. 1.

In FIGS. 1 and 2, fluids from separate sources are co-mingled in a jet pump 14. Sources of high and low pressure fluids for the jet pump are obtained in this example from underground oil wells, a first source of fluid. 11 under low pressure and a second source of fluid 12 under high pressure. Both fluids are mixtures of gas and liquid.

The fluid from the high pressure oil well is used to pump fluid from the low pressure well.

The fluid mixture under low pressure is supplied to the low pressure inlet 14G of a conventional jet pump 14. The high pressure fluid passes first to au in-line separator 15, in which the lighter phase tends to return to the line of entry and the heavier fluids are deflected from that line. This is usually achieved by imparting a swirl to the incoming fluid, the centrifugal force acting to separate the different phases. The gas rich fluid tends to collect along the axis of the swirl, in line with the incoming fluid and the heavier phase is collected from an off-axis outlet.

The liquid phase (or liquid rich fluid) 15L separated from the high pressure fluid is supplied as primary fluid to the high pressure inlet 14L of the jet pump 14. The gas-rich phase 15G separated from the high pressure fluid passes through a bypass conduit 24, and the conduit may be provided with a device for controlling the flow of the gas in the bypass conduit; the device may be an orifice plate, a nozzle (as illustrated at 26) at the end of the bypass conduit 24 or a controllable valve, which is useful when inlet pressures may vary during operation.

Since the primary fluid reaching the high pressure inlet 14L of the jet pump is substantially all liquid phase, the jet pump 14 operates satisfactorily to draw low pressure fluid from the first source through the pump and the mixture of liquids passes from the jet pump outlet 27, into a mixing device 28 where it is mixed with the gas stream from the separator 15.

It will be noted that the mixing device 28 is housed in an extension of the outlet pipe 27 of the jet pump; the diameter of the extension increases in the region of the entry of the gas bypass conduit outlet. The role of the mixing device is to allow efficient entry of the bypass gas into the fluid leaving the jet pump. Since the pressure of the two fluids may be comparable at this point the mixing device must reduce the effect which the high pressure bypass gas may have in restricting the flow cut of the jet pump. In fact the bypass gas is problably at a higher pressure than the fluids in the outlet of the jet pump and so it is preferable for the outlet of the bypass conduit to form what can be seen as another jet pump in the outlet conduit from the main jet pump, thus assisting the flow of fluids from the main jet pump, recovering momentum lost from the high pressure oil stream at the phase separator. Certainly the bypass gases should be introduced in a streamline manner, such as by directing the gases axially along the outlet conduit, to prevent any disruption of the flow from the outlet of the main jet pump. The effect of the outlet fluids from the main jet pump on the flow of gas in the bypass conduit controls the operation of the phase separator; its back pressure discourages any carry-over of liquid slugs through the bypass conduit; it is thus a passive controller.

The gas from the separator 15 need not be mixed back with the output fluids from the jet pump. The gas may for example be fed to a flare or a fuel system.

Figure 3:
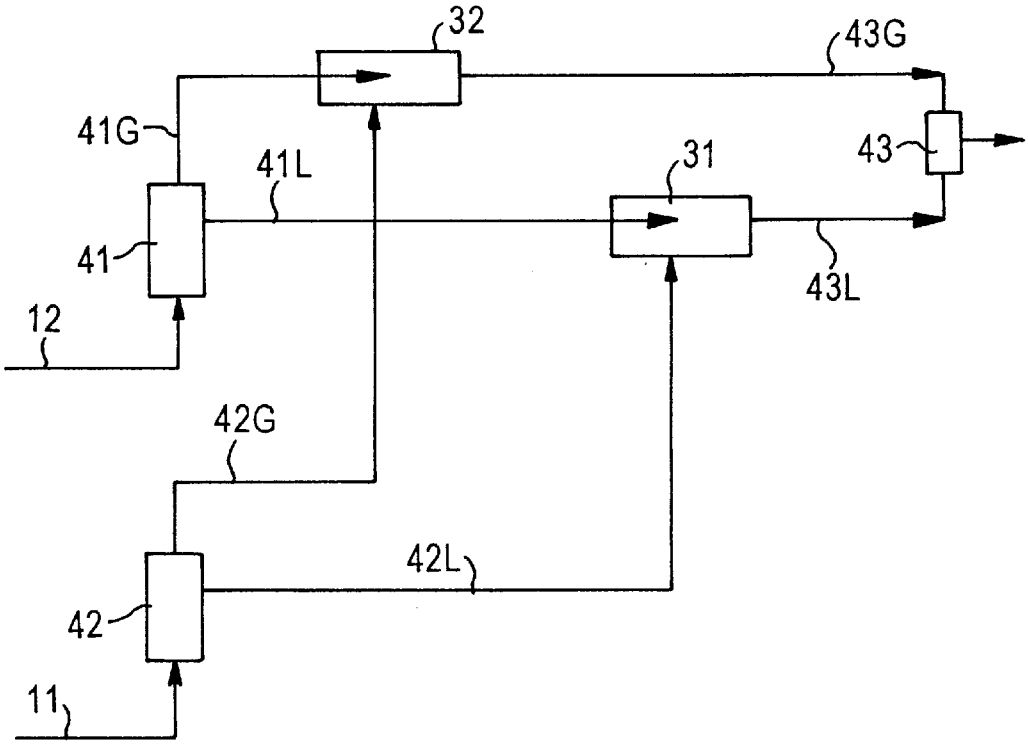
FIG. 3 is a diagram of a similiar co-mingling system, incorporating two jet pumps.

In FIG. 3 there are two jet pumps 31, 32 in parallel and two phase separators 41, 42, one in the supply from each well. The first jet pump 31 receives liquid at each of its inputs,; the liquid phase output 41L from the high pressure well separator 41 as its primary fluid and the liquid phase output 42L from the low pressure well separator 42 as its secondary input, co-mingling them to produce a liquid supply 43L to the single mixing device 43. The second pup 32 receives gas-rich fluid at each of its inputs, the gas phase output 41G from the high pressure well separator 41 an its primary fluid and the gas phase output 42G from the low pressure well separator 42 as its secondary fluid, comingling the gases to produce a gas supply 43G to a single mixing device 43. Jet pumps receiving the same phase for primary and secondary fluids have improved performance, as was pointed out in the introduction to the specification.

The jet rump 14 in FIGS. 1 and 2 has a liquid enriched supply of driving fluid, but the supply from the low pressure well is unseparated and so may contain unsatisfactory amount of gas. In FIG. 3 both jet pump 31, 32 have phase separated supplies and so do not have to deal with such a wide range of phase-proportions; they can therefore be much more closely designed and so should work more efficiently.

What is claimed is:

1. A device for co-mingling fluids from separate sources, comprising:

a jet pump having a high pressure inlet for receiving a high pressure fluid, a low pressure inlet for receiving a fluid from a first source of fluid, followed by a diverging section and a main outlet for discharging a mixture of fluids received from the high pressure inlet and the low pressure inlet; and a phase separator having an inlet for receiving a fluid from a second source of fluid, a liquid-rich outlet connected to the high pressure inlet of the jet pump for supplying liquid-rich material to the jet pump, and a gas-rich outlet connected downstream of the main outlet of the jet pump, so that fluids from the gas-rich outlet of the separator are mixed with fluids discharged by the jet pump.

2. A device according to claim 1, wherein the first source of fluid is under low pressure and the second source of fluid is under a higher pressure than the first source.

3. A device according to claim 1, further comprising:

a mixing device having a first input connected to the main outlet of the jet pump and a second input connected to the gas-rich outlet of the separator, for mixing fluids from said main outlet with fluids from the gas-rich outlet.

4. A device according to claim 3, wherein the mixing device comprises a nozzle directed along an axis of the main outlet.

5. A co-mingling device for mingling a first fluid and a second fluid, comprising a jet pump having a high pressure inlet, a low pressure inlet for receiving the first fluid and a main outlet; and a phase separator having an inlet for receiving the second fluid, a liquid-rich outlet which is connected to said high pressure inlet and a gas-rich outlet which is connected to said main outlet, wherein fluids from the gas-rich outlet are mixed with fluids from the jet pump only after said fluids from the gas-rich outlet and jet pump have passed said main outlet;

wherein said jet pump is a first jet pump having a high pressure inlet, a low pressure inlet and a main outlet, and said phase separator is a first phase separator having an inlet and a liquid-rich outlet, said liquid-rich outlet connected to said high pressure inlet of the first jet pump;

the device further comprising a second jet pump having a high pressure inlet, a low pressure inlet and a main outlet, and a second phase separator having an inlet and a liquid-rich outlet, said liquid-rich outlet connected to said low pressure inlet of the first jet pump, the first phase separator having a gas-rich outlet connected to the high pressure inlet of the second jet pump and the second phase separator having a gas-rich outlet connected to the low pressure inlet of the second jet pump.

6. A device as claimed in claim 5, wherein each phase separator is an in-line separator in which the gas-rich outlet is aligned with the inlet of the phase separator.

7. A device as claimed in claim 5 comprising mean to mix the outlets of the two jet pumps.

* * * * *